US008002262B2

(12) United States Patent
Kelty et al.

(10) Patent No.: US 8,002,262 B2
(45) Date of Patent: Aug. 23, 2011

(54) METHOD FOR APPLYING PICK RETRY USING A MODIFIED PICK ROLLER FORCE TO REDUCE LIKELIHOOD OF FAILURE TO PICK TOP SHEET FROM STACK

(75) Inventors: Adam Christopher Kelty, Georgetown, KY (US); Charles Brandon Langrel, Lexington, KY (US)

(73) Assignee: Lexmark International, Inc., Lexington, TX (US)

( * ) Notice: Subject to any disclaimer, the term of this patent is extended or adjusted under 35 U.S.C. 154(b) by 0 days.

(21) Appl. No.: 12/326,230

(22) Filed: Dec. 2, 2008

(65) Prior Publication Data

US 2010/0133740 A1 Jun. 3, 2010

(51) Int. Cl.
*B65H 5/00* (2006.01)

(52) U.S. Cl. ..... 271/10.03; 271/118

(58) Field of Classification Search ..... 271/10.03, 271/117, 118, 109, 110, 111; 399/19, 20, 399/21

See application file for complete search history.

(56) References Cited

U.S. PATENT DOCUMENTS

| | | | | |
|---|---|---|---|---|
| 4,561,644 | A * | 12/1985 | Clausing | 271/34 |
| 4,919,412 | A * | 4/1990 | Weigel et al. | 271/110 |
| 4,925,177 | A * | 5/1990 | Nakamura et al. | 271/110 |
| 5,465,949 | A * | 11/1995 | Yamada et al. | 271/110 |
| 5,927,703 | A * | 7/1999 | Endo | 271/10.03 |
| 7,413,182 | B2 * | 8/2008 | Powell et al. | 271/10.03 |
| 2004/0245704 | A1 * | 12/2004 | Hall et al. | 271/117 |

* cited by examiner

*Primary Examiner* — Jeremy R Severson
(74) *Attorney, Agent, or Firm* — John Victor Pezdek

(57) ABSTRACT

A method for applying a pick retry using a modified pick roller force includes operating an actuator in a first duty cycle to cause a pick roller to impose a first force on a media stack ordinarily sufficient to pick and feed a top sheet from the media stack to a media path, sensing whether or not the sheet arrives in the media path, and retrying the actuator in a second duty cycle different than the first duty cycle to cause the pick roller to impose a second force on the media stack different from the first force in response to not sensing the arrival of the sheet in the media path. The second force may be greater than the first force. The second duty cycle may be longer than the first duty cycle. Also, the method includes rotating the pick roller concurrently with or subsequently to operating the actuator.

8 Claims, 3 Drawing Sheets

METHOD FOR APPLYING PICK RETRY USING A MODIFIED PICK ROLLER FORCE TO REDUCE LIKELIHOOD OF FAILURE TO PICK TOP SHEET FROM STACK

BACKGROUND

1. Field of the Invention

The present invention relates generally to an automatic document feeder for a scanning device and, more particularly, to a method for applying a pick retry using a modified pick roller force to reduce the likelihood of failure to pick the top sheet from a media stack.

2. Description of the Related Art

It is common for an automatic document feeder (ADF) for a scanning device to include a pick roller to move the top sheet of an input media stack into the ADF feed path. There are different methods for engaging the pick roller to the input media, but the desired result is the same. The pick roller should move only the top sheet of the input media. There is an operating window for the pick roller to ensure enough force is created to move the top sheet, but not too much such that subsequent sheets are not moved. Thus, it is common for the pick roller to have just enough force to move the top sheet of the input media stack.

In some cases, it is possible that this force is not great enough and the ADF fails to move the top sheet far enough to the media path and reports a jam. It is also possible that the input media condition is not ideal, and this undesired condition of the media creates problems when trying to move the top sheet of the input stack. Thus, it is common for some ADF devices to incorporate a retry of the pick roller if it fails to feed the top sheet. However, it is possible that the retry of the pick roller will turn out to be ineffective also and thus end in failure.

Thus, there is still a need for an innovation that will establish a parameter that will ensure the success of the retry of the pick roller in response to its failure to feed the top sheet.

SUMMARY OF THE INVENTION

The present invention meets this need by providing an innovation that ensures that a pick retry will proceed with a modified pick roller force to further help reduce the chances of an ADF failure to move the top sheet from the media stack. The innovation is a method for applying a retry to an ADF pick roller such that during the retry the pick force is modified.

Accordingly, in an aspect of the present invention, a method for applying a pick retry using a modified pick roller force includes operating an actuator in a first duty cycle to cause a pick roller to impose a first force on a media stack ordinarily sufficient to pick and feed a top sheet from the media stack to a media path, sensing whether or not the sheet arrives in the media path, and retrying the actuator in a second duty cycle different than the first duty cycle to cause the pick roller to impose a second force on the media stack different from the first force in response to not sensing the arrival of the sheet in the media path. The second force may be greater than the first force. The second duty cycle of the actuator may be longer than the first duty cycle. Also, the method includes rotating the pick roller concurrently with or subsequently to operating the actuator to cause the pick roller to impose the first force on the media stack.

BRIEF DESCRIPTION OF THE DRAWINGS

Figure 1:
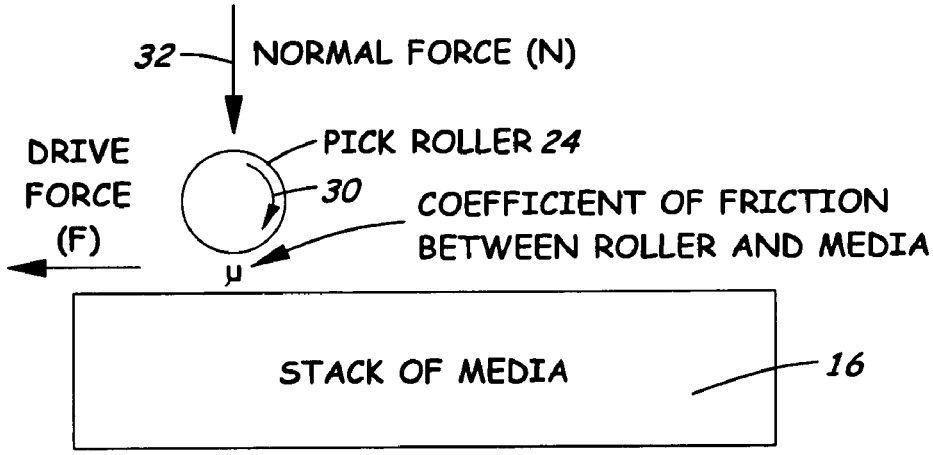

Having thus described the invention in general terms, reference will now be made to the accompanying drawings, which are not necessarily drawn to scale and in some instances portions may be exaggerated in order to emphasize features of the invention, and wherein:

FIG. 1 is a simplified diagrammatic view of a prior art relationship of a pick roller with a media stack in a top sheet pick operation and the different forces involved in the relationship.

Figure 2:
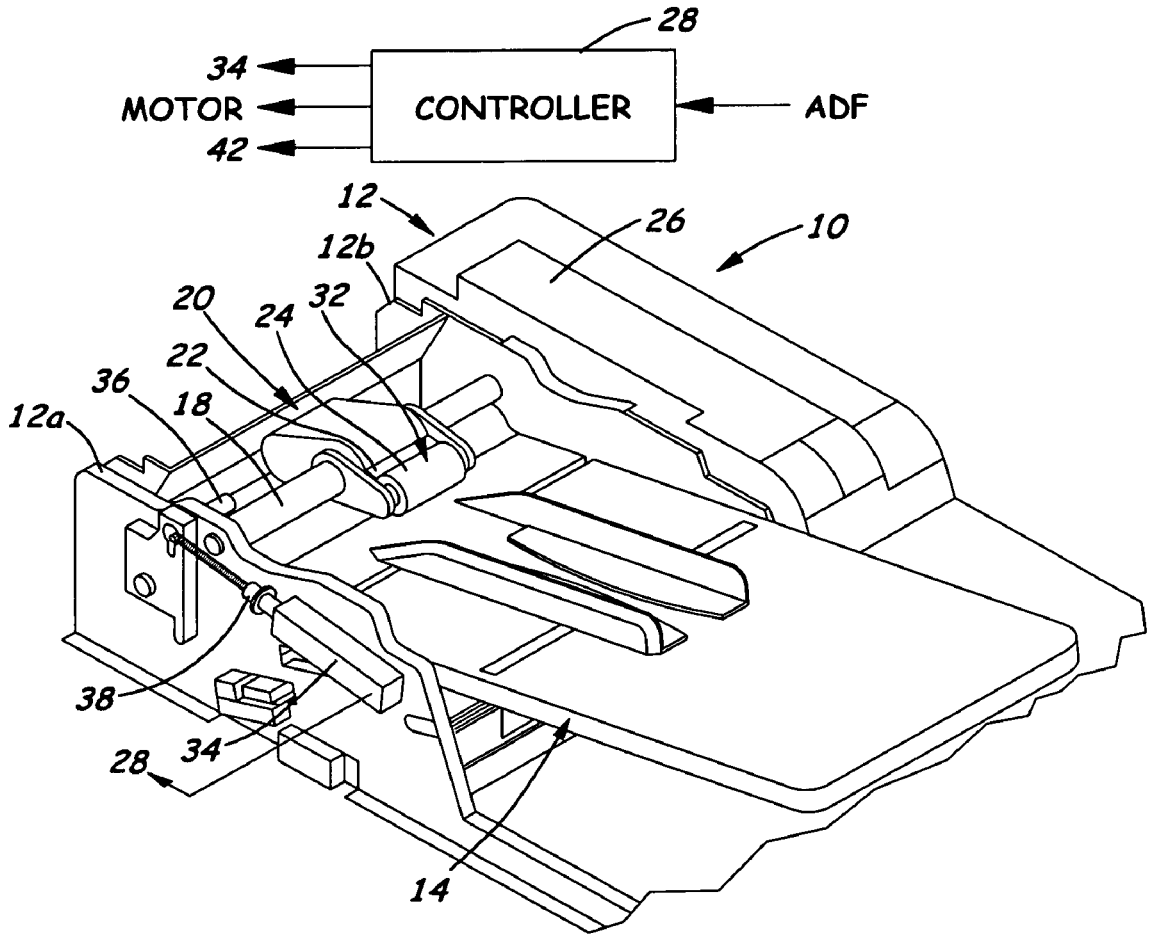

FIG. 2 is an exemplary embodiment of a prior art ADF in which the method of the present invention is implemented for applying a pick retry using a modified pick roller force.

Figure 3:
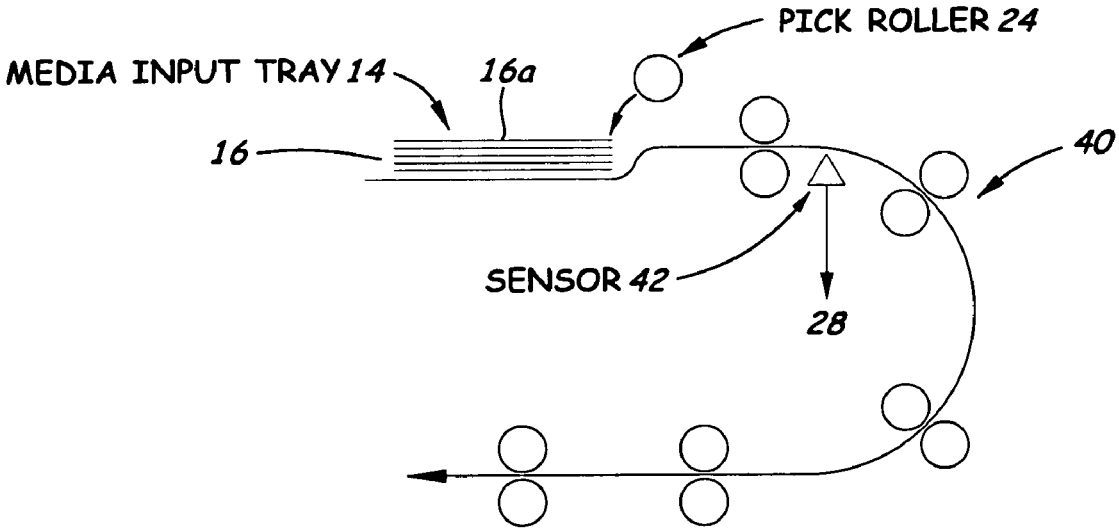

FIG. 3 is a simplified diagrammatic view of a prior art ADF media path for illustrating a sequence of events relating to the method of the present invention.

Figure 4:
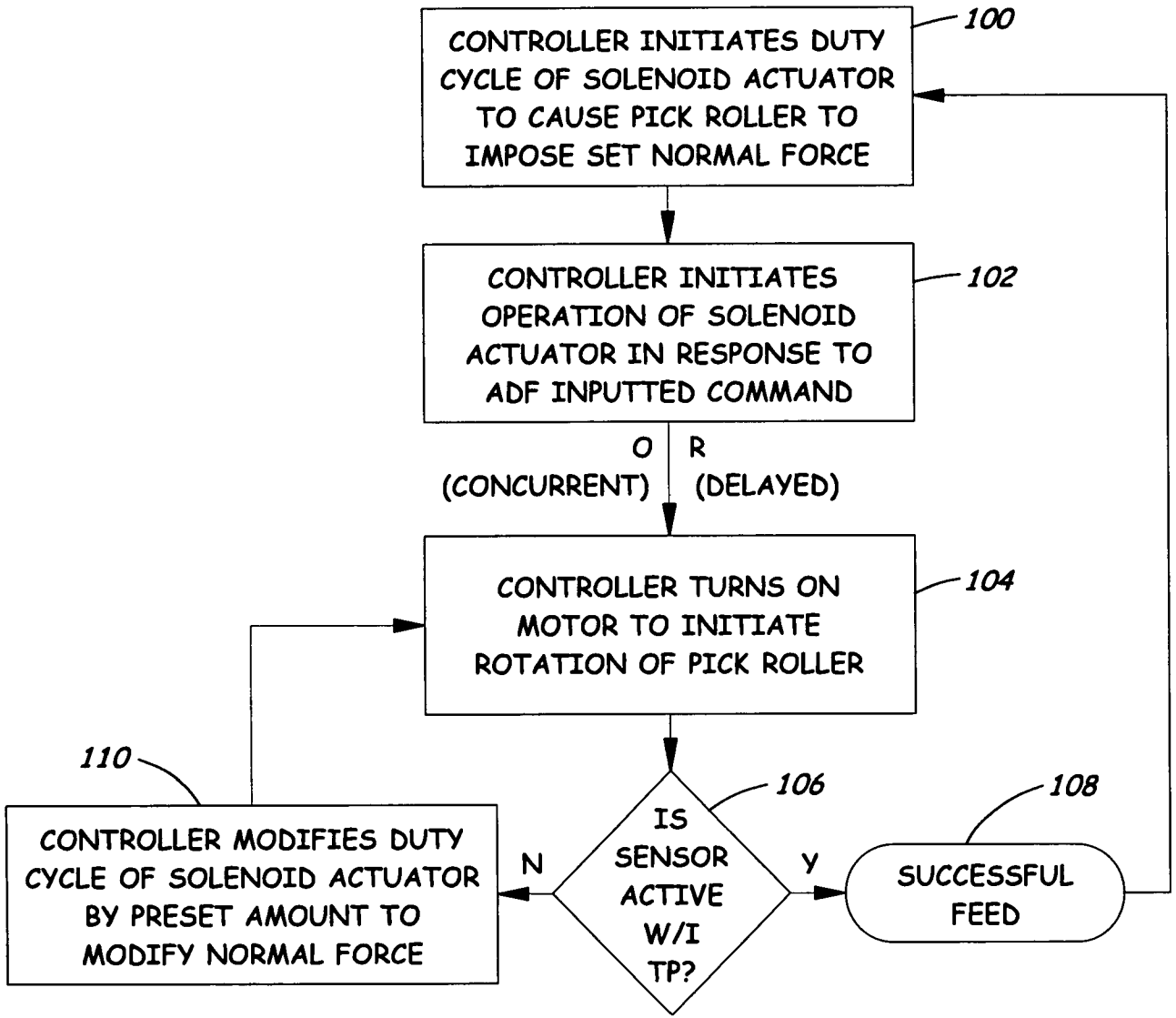

FIG. 4 is a flowchart depicting the operational steps of the method of the present invention for applying a pick retry using a modified pick roller force.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1 and 2, there is diagrammatically illustrated in FIG. 1 an input tray setup of a prior art automatic document feeder (ADF) 10, as seen in FIG. 2, for a scanning device. The ADF 10 includes a housing frame 12, an input tray 14 supported by the housing frame 12 for receiving and supporting a media stack 16, a shaft 18 rotatably mounted at its opposite ends to opposite sides 12*a*, 12*b* of the housing frame 12, and a pick mechanism 20 having a pick arm 22 pivotally mounted on the shaft 18 so as to overlie the input tray 14. The pick mechanism 20 has a pick roller 24 movably, and specifically rotatably, mounted to an end of the pick arm 22 so as to overlie a media stack 16 supported on the input tray 14. The pick roller 24 is rotatably driven by a train of gears (not shown) mounted in the pick arm 22 which, in turn, are driven by a motor (not shown), such as a stepper motor, located under a cover 26.

The ADF 10 also includes a controller 28 electrically connected to the motor. The controller 28 operates as instructed by software contained therein to command the turn-on and operation of the motor such that the pick roller 24 is rotated in clockwise direction of an arrow 30 shown in FIG. 1 to apply a drive force (F) to the media stack 16 to move its top sheet 16*a* (see FIG. 3) laterally off the media stack 16. The drive force (F) exerted by the pick roller 24 on the media stack 16 can simply be expressed by the following equation: $F=\mu*N$, where F is the drive force applied to the media stack 16, $\mu$ is the coefficient of friction between the pick roller 24 and the media stack 16, and N is a normal force that the pick roller 24 applies to the media stack 16 in the downward direction of an arrow 32 shown in FIG. 1.

As seen in FIG. 2, the ADF 10 also includes an extendable and retractable mechanism in the form of a solenoid actuator 34 supported on the exterior of the housing frame 12. The operation of the solenoid actuator 34, as well-known, is controlled and directed by the controller 28 to actuate the pivotal movement of the pick arm 22. The ADF 10 further includes a cam 36 mounted at the one side 12*a* of the housing frame 12 on one end of the shaft 18. The duty cycle of the solenoid actuator 34 creates a lateral force that rotates the cam 36 through a given angle, with the cam 36, in turn, providing a corresponding known torque force to the pick arm 22. The pick arm 22 then pivots and the pick roller 24 thereon provides the resulting corresponding known downward normal force on the media stack 16. The solenoid actuator 34 operates based on a duty cycle that is controlled by the software in the controller 28. The software sets the duty cycle at some given percentage from 0 to 100%. As the duty cycle increases, the holding force of the plunger 38 of the solenoid actuator 34 increases which, in turn, correspondingly increases the normal force of the pick roller 24 on the media stack 16.

Turning now to FIGS. 3 and 4, there is illustrated in FIG. 3 a simplified diagrammatic view of a prior art ADF media path, generally designated 40. FIG. 4 sets forth a plurality of blocks 100-110 making up a flowchart of the method of the present invention. During normal operation of the ADF 10, the controller 28 receives a command to feed a sheet from the media stack 16. The controller 28 issues a pick command to the solenoid actuator 34 in response to which the duty cycle of the solenoid actuator 34 is preset at a given default interval between 0 and 100% to create the desired force via the cam 36 that the pick roller 24 imposes on the input media stack 16. Also, concurrently the controller 28 commands the motor to turn on, causing the pick roller 24 to rotate. As the pick roller 24 rotates, it is intended to move the top sheet 16*a* to the ADF media path 40.

A well-known sensor 42 is situated along the media path 40 at a location where it may be used to detect if the top sheet 16*a* has successfully fed into the ADF media path 40. When the sensor 42, operating in a well-known manner, goes active in response to detection of the top sheet 16*a*, its active state is communicated to and monitored by the controller 28 which, in turn, communicates an appropriate signal to the solenoid actuator 34 to disengage the pick roller 24 via the cam 36. The pick roller 24 then moves back to its original position until the next pick command is given. If the sensor 42 fails to activate within a preset time period, then the operational assumption is that the top sheet 16*a* did not feed successfully into the ADF media path 40. Thus, in response to the sensor failing to activate within the preset time period, the controller 28 of the ADF 10 reports a jam condition.

In accordance with the method of the present invention, a retry will be created by the controller 28 when the sensor 42 fails to activate within the preset period of time. To start at the beginning, initially, as per block 100 of the flowchart, the controller 28 initiates the default interval of the duty cycle of the solenoid actuator 34 to cause the pick roller 24 to deliver a first, or default level, normal force on the media stack 16, ordinarily found sufficient for picking and moving the top sheet 16*a* from the stack 16 and into the ADF media path 40 to where its successful arrival will be sensed by the sensor 42. At block 102, in response to receipt of an appropriate command inputted to the ADF 10, the controller 28 initiates operation of the solenoid actuator 34 to impose, via the cam 36 and pick mechanism 20, the first normal force on the media stack 16. The controller 28, at the same time, as per block 104, turns on the motor causing the pick roller 24 to rotate.

Next, as per block 106, the controller 28 monitors the state of the sensor 42 to determine the answer to the question "Is sensor active w/i TP?" meaning, within a preset time period (TP). If the answer is yes (Y), the method branches to block 108 where a successful feed is indicated. From block 108, the method returns to the first block 100 to await when another command is received from the ADF 10 to pick another sheet from the media stack 16. However, it the answer at block 106 is no (N), then the method branches to block 110 where the controller 28 initiates a 'retry'. The retry is a repeat operation of the solenoid actuator 34.

However, this time on the retry the controller 28 causes the pick roller 24 to impose, via the cam 36 and pick mechanism 20, on the media stack 16 a second normal force which is modified over that of the first normal force by an amount calculated to feed the top sheet 16*a* from the media stack 16. In the exemplary embodiment herein, the controller 28 does this by increasing the duty cycle of the solenoid actuator 34 so as to increase the pick roller-imposed normal force on the media stack 16 during the retry. The repeat operation or retry of the method commences at the block 102 where the controller 28 again initiates the aforementioned operation of the solenoid actuator 34 for the increased duty cycle to cause the pick mechanism 20 to deliver the increased second normal force. The method then moves to block 104, where the motor is turned on and rotates the pick roller 24, and then to block 106 where the controller 28 monitors the sensor 42 for the preset time period. This should result in an answer of yes (Y) at block 106, indicating a successful feed at block 108.

Another variation of the retry is for the controller 28 to operate the solenoid actuator 34 to move the pick roller 24 to the media stack 16, but not concurrently activate the motor. So the pick roller 24 is pressed onto the media stack 16 with a higher normal force during the retry, but not yet moving (rotating). Then, next the motor is activated and rotates the pick roller 24. This sequence would prevent the slipping of the pick roller 24 relative to the media stack 16 that may have caused the misfeed originally.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A method for applying a pick retry using a modified pick roller force, comprising:

operating an actuator in a first duty cycle to create a force to rotate a cam connected to a pick roller, the rotation of the cam causing the pick roller to move down into contact with a media stack and to impose a first intermittent force on the media stack ordinarily sufficient to pick and feed a top sheet from the media stack to a media path;

sensing whether or not the sheet arrives in the media path within a predetermined time period after start of operating the actuator in the first duty cycle; and retrying the actuator in a second duty cycle larger than the first duty cycle to cause the pick roller to move down into contact with the media stack and to impose a second intermittent force on the media stack greater than the first intermittent force in response to not sensing the arrival of the sheet in the media path.

2. The method of claim 1 further comprising:

repeating said operating the actuator in the first duty cycle in response to sensing the arrival of the sheet in the media path.

3. The method of claim 1 further comprising:

rotating the pick roller concurrently with said operating the actuator to cause the pick roller to impose the first intermittent force on the media stack.

4. The method of claim 1 further comprising:

rotating the pick roller subsequent to said operating the actuator to cause the pick roller to impose the first intermittent force on the media stack.

5. A method for applying a pick retry using an increased pick roller normal force, comprising:

operating an actuator in a first duty cycle to create a force to rotate a cam connected to a pick roller, the rotation of the cam causing the pick roller to move down into contact with a media stack and to impose a first intermittent normal force on the media stack ordinarily sufficient to pick and feed a top sheet from the media stack to a media path;

sensing whether or not the sheet arrives in the media path within a predetermined time period after start of said operating the actuator in the first duty cycle; and retrying the actuator in a second duty cycle larger than the first duty cycle to cause the pick roller to move down into contact with the media stack and to impose a second intermittent normal force on the media stack larger than the first intermittent normal force in response to not sensing the arrival of the sheet in the media path.

6. The method of claim 5 further comprising:

repeating said operating the actuator in the first duty cycle in response to sensing the arrival of the sheet in the media path.

7. The method of claim 5 further comprising:

rotating the pick roller concurrently with said operating the actuator to cause the pick roller to impose the first intermittent normal force on the media stack.

8. The method of claim 5 further comprising:

rotating the pick roller subsequent to said operating the actuator to cause the pick roller to impose the first intermittent normal force on the media stack.

* * * * *